US012310518B2

(12) United States Patent
Malcolm

(10) Patent No.: US 12,310,518 B2
(45) Date of Patent: May 27, 2025

(54) SYSTEM FOR INTERACTING WITH FOOD

(71) Applicant: Constructive Eating, Ann Arbor, MI (US)

(72) Inventor: Carter T. Malcolm, Ann Arbor, MI (US)

( * ) Notice: Subject to any disclaimer, the term of this patent is extended or adjusted under 35 U.S.C. 154(b) by 0 days.

(21) Appl. No.: 17/566,839

(22) Filed: Dec. 31, 2021

(65) Prior Publication Data

US 2023/0210283 A1 Jul. 6, 2023

(51) Int. Cl.
*A47G 19/06* (2006.01)
*A47G 19/10* (2006.01)
*B65D 1/36* (2006.01)

(52) U.S. Cl.
CPC ..... *A47G 19/06* (2013.01); *A47G 19/10* (2013.01); *B65D 1/36* (2013.01)

(58) Field of Classification Search
CPC ..... A47G 19/06; A47G 19/10; A47G 19/02; A47G 19/065; A47G 23/06; A47G 23/0633; B65D 1/36
USPC ..... 220/574.1, 575, 574; 206/553
See application file for complete search history.

(56) References Cited

U.S. PATENT DOCUMENTS 3,796,454 A * 3/1974 Williamson ..... A47J 43/283 294/7
5,328,051 A * 7/1994 Potter ..... A47G 19/02 220/575
5,593,062 A * 1/1997 Martin ..... A47G 19/065 220/575
5,607,077 A * 3/1997 Torkelson ..... A47G 19/065 206/217
5,887,749 A * 3/1999 Schommer ..... A47G 19/02 220/575
11,064,828 B1 * 7/2021 Joyner ..... A47G 19/06
2002/0036205 A1 * 3/2002 Balakumar ..... A47G 21/00 220/575
2010/0239407 A1 * 9/2010 Mills ..... A47G 19/10 248/205.8
2012/0111873 A1 * 5/2012 Gabriel ..... A47G 19/06 220/574.1
2015/0282655 A1 * 10/2015 Donovan ..... A47G 19/06 30/142
2019/0045957 A1 * 2/2019 Patterson ..... B65D 1/36
2020/0337481 A1 * 10/2020 Montgomery ..... A47G 19/06

* cited by examiner

*Primary Examiner* — Robert Poon
(74) *Attorney, Agent, or Firm* — Dickinson Wright PLLC

(57) ABSTRACT

A system for interacting with food includes a rigid plate with a plurality of recessed regions formed in a body portion of the plate. The recessed regions are arranged to define a shape of an object such as a vehicle or animal for appealing to a young child. One or more of the recessed regions may include a nesting region having a shape substantially matching the shape of a head portion of a utensil for use with the plate. The recessed regions may also include a dock portion that mates with and elevates a head portion of an associated utensil above the lower surface of the recessed region. The body portion may include a retention feature that mates with and retains and handle portion of the utensil. Transition regions between the walls and the lower surfaces of recessed regions may match the shape of the head of the utensil.

33 Claims, 10 Drawing Sheets

SYSTEM FOR INTERACTING WITH FOOD

FIELD

The present invention generally relates to dishes and utensils configured to interact with food items.

BACKGROUND

Young children usually begin self-feeding by using their hands to bring food from a plate or tray to their mouths. As children develop, they eventually begin using utensils to transport food from the plate to their mouths. However, as many caregivers have experienced, children typically can go through periods in their development where they become picky eaters. Additionally, children can go through periods where they become messy eaters. In many instances, the combination of becoming a messy eater and a picky eater may result in frustration and refusal by the children manifesting in intentionally or unintentionally spilled food. Various methodologies have been developed and refined by caregivers to reduce these instances.

One such methodology involves providing dishes and/or utensils that have corresponding images displayed thereon that are familiar and pleasing to the child, such as a favorite character from a movie or television program, or a favorite toy, such as a dinosaur or truck. However, the dish or utensil may become covered or blocked by the food itself, and such a methodology is also insufficient in the event the child is not pleased by the image that day, which frequently occurs.

Another example is the use of a flexible dish that can be pressed into place on a table, tray or other eating surface. These flexible dishes may thereby be secured to the surface via suction, and may be constructed of a bright color that is pleasing to the child. In this example, the dish may be secured to the surface, but the flexible nature of the dish enables the child to push food over its edge. Additionally, while the dish may initially be secured, a child may be able to use only one hand and break the suction seal for the dish, thereby converting the dish into a flying object or a hat, if desired. Furthermore, transporting food to and from a child's eating area, such as a table or high chair, can be difficult when using flexible dishes and can lead to undesirable spilling.

Additionally, traditional dishes and utensils, even if temporarily secured or including a pleasing image, may provide difficult to use for young children with regard to grasping or manipulating the utensil in combination with the plate. For example, a young child may have trouble holding a spoon, or have trouble using the spoon to scoop the food from the plate. Similarly, the child may inadvertently mix one food with another while attempting to retrieve the food with the spoon, which can result in an unintended and undesirable culinary creation, further hindering the feeding process.

SUMMARY

According to an aspect of the present disclosure, a system for interacting with food is provided. The system includes: a plate having a body portion; interconnected walls within the body portion defining a plurality of recessed regions having sidewalls; the interconnected walls defining an uppermost surface, wherein the plurality of recessed regions include a lower surface recessed relative to the uppermost surface; and at least one retention feature positioned on the uppermost surface of at least one of the interconnected walls, wherein the at least one retention feature is configured to retain a utensil for use with the plate.

In one aspect, at least one of the recessed regions includes a nesting region having a shape substantially matching the shape of a head portion of a utensil for use with the plate.

In one aspect, multiple recessed regions include a nesting region having a shape substantially matching the shape of a head portion of a utensil for use with the plate.

In one aspect, one of the recessed regions includes a dock portion configured to retain the head portion of a utensil for use with the plate.

In one aspect, the dock portion includes a ledge that elevates the head portion of a utensil for use with the plate above the bottom surface of the recessed region.

In one aspect, the recessed regions have a transition region between the walls defining the recessed regions and the bottom surface of the recessed regions, wherein the transition region is different for at least one of the recessed regions as compared to the transition region of at least one other recessed region.

In one aspect, the transition region of at least one recessed region is substantially curved.

In one aspect, the transition region of at least one recessed region that is substantially curved is configured to mate with a curved head portion of a utensil for use with the plate.

In one aspect, the transition region of at least one recessed region forms a substantially right angle between the wall and bottom surface of the recessed region.

In one aspect, the transition region that forms a substantially right angle between the wall and bottom surface of the recessed region is configured to mate with at least one straight head portion of a utensil for use with the plate.

In one aspect, the plate is constructed of a substantially rigid material. In another aspect, the plate is constructed of a substantially flexible material.

In one aspect, the at least one retention feature is configured to mate with a cavity in at least one utensil for use with the plate.

In one aspect, the at least one retention feature comprises multiple retention features positioned on the uppermost surface of at least one of the walls, and configured to retain at least one utensil for use with the plate.

In one aspect, the multiple retention features comprises a plurality of projections including a middle projection disposed between a pair of side projections, wherein a space is defined between the middle projection and the side projections for retaining an associated utensil.

In one aspect, at least one of the retention features positioned on the uppermost surface of at least one of the sidewalls is configured to retain at least one utensil associated with the plate, and at least one of the multiple retention features positioned on the uppermost surface of at least one of the sidewalls is configured to retain at least one other different utensil for use with the plate.

In one aspect, at least two of the recessed regions are separated so as to include non-contiguous lower surfaces, but which recessed regions are fluidically connected by a passageway extending below the uppermost surface.

In one aspect, the passageway fluidically connecting at least two recessed regions includes a ramp to facilitate the transfer of food from one recessed region to another recessed region.

In one aspect, the ramp includes different segments with different angles of incline.

In one aspect, the plate includes a plurality of flange portions projecting laterally outward from the body portion, wherein the flange portions are disposed below the uppermost surface of the body portion.

In one aspect, the system includes a plurality of securement members attached to the flange portions, wherein the securement members are flexible and project below a bottommost surface of the body portion of the plate.

In one aspect, the plurality of flange portions comprise three flange portions and three associated securement members.

In one aspect, the plate is configured to be secured to a surface by three securement members positioned at points on a periphery of the plate to resist tipping or flipping of the plate.

In one aspect, the flanges each define slots extending along a vector directed toward the body portion of the plate, wherein the securement members are disposed within the slots, and wherein a lateral force applied to the plate is resisted by at least one of the securement members and the associated slot.

In one aspect, the securement members are removable from the plate. In another aspect, the securement members are integrated into the plate.

In another aspect, a system for interacting with food is provided, including: a plate have a body portion including a plurality of interconnected walls that combine to define a plurality of recessed regions; a first recessed region of the plurality of recessed regions that is recessed relative to an uppermost surface of the body portion; a second recessed region of the plurality of recessed regions that is recessed relative to the uppermost surface of the body portion; wherein the first and second recessed regions are separated so as to include non-contiguous lower surfaces, a passageway fluidically connecting the first recessed region and the second recessed below the uppermost surface of the body portion; and a third recessed region of the plurality of recessed regions that is recessed relative to the uppermost surface of the body portion and fluidically isolated from the first and second recessed regions below the uppermost surface.

In one aspect, the passageway fluidically connecting the first and second recessed regions includes a ramp to facilitate the transfer of food from the second recessed region to the first recessed region.

In one aspect, the first recessed region includes a dock portion configured to retain a head portion of a utensil for use with the plate, wherein the dock portion includes a ledge that elevates the head portion of the utensil for use with the plate above a bottom surface of the second recessed region.

In one aspect, the system includes a plurality of retention features formed on the upper surface of one of the walls that defines, in part, the first recessed region.

In one aspect, the retention features are disposed on an opposite side of the first recessed region relative to the dock portion, wherein the retention features are configured to retain a handle portion of the utensil for use with the plate.

In one aspect, the system includes a plurality of securement members removably attached to flange portions of the plate, wherein the securement members project below a bottommost surface of the body portion of the plate and are configured to secure the plate to a support surface.

In another aspect, a system for interacting with food is provided, including: a plate having a body portion having a plurality of interconnected walls defining a plurality of recessed regions below an upper surface defined by the interconnected walls; a first utensil configured for being retained by the body portion of the plate; a dock portion defined in a first recessed region of the plurality of recessed regions; a retention feature defined on the upper surface of one of the walls that defines the first recessed region; wherein a head portion of the first utensil has a size and shape corresponding to the dock portion, and wherein the head portion mates with the dock portion in an elevated position relative to a bottom surface of the first recessed region; wherein a handle portion of the first utensil is configured to mate with and be retained by the retention feature.

In one aspect, the handle portion of the first utensil includes a cavity and the head portion of the first utensil defines a rounded end portion, wherein the cavity receives and mates with at least one projection of the retention feature to retain the handle portion and the rounded end portion mates with a ledge of the dock portion.

In one aspect, at least two of the plurality of recessed regions include a transition region between a bottom surface of the recessed region and the wall defining the recessed region, wherein the transition region is different for at least one of the recessed regions as compared to the transition region of at least one other recessed region, wherein at least one of the transition regions is configured to mate with the head portion of the first utensil.

In one aspect, at least one of the recessed regions includes a nesting region having a shape substantially similar to the shape of the head portion of the first utensil.

In one aspect, at least two recessed regions are separated so as to include non-contiguous lower surfaces, but which recessed regions are fluidically connected by a passageway extending below the upper surface of the walls of the recessed regions, wherein the passageway fluidically connecting the at least two recessed regions includes a ramp to facilitate the transfer of food from one recessed region to another recessed region.

DETAILED DESCRIPTION

It should be noted initially that the illustrated plate and utensils define a theme corresponding to a construction vehicle in one aspect, with a plate shaped like a wheeled front loader, and that the plate is also illustrated as a water or sea animal, such as a turtle, in another aspect. It will be understood that the various aspects of the present disclosure may be applied to other themes, such as construction vehicles, spaceships, emergency vehicles, farm equipment, dinosaurs, unicorns, castles, pirate ships, and the like. The present disclosure is not just limited to the illustrated or explicitly described themes. Additionally, it should be understood that any one of a number of different utensil types may be utilized along with the plate, such as, but not limited to, spoons, forks, knives, pushers, sporks, spatulas, or any implement for manipulating food.

Referring to FIGS. 1-12, one example of a system 100 for interacting with food is shown. The system 100 may include a plate 102, a first utensil 103 (FIGS. 8-9), and a second utensil 104 (FIG. 10-11), in one example. It will be appreciated that the system 100 may, in one aspect, be limited to the plate 102, or may include additional utensils or fewer utensils. For purposes of the discussion, the illustrated system 100 will continued to be referenced herein.

Figure 1:
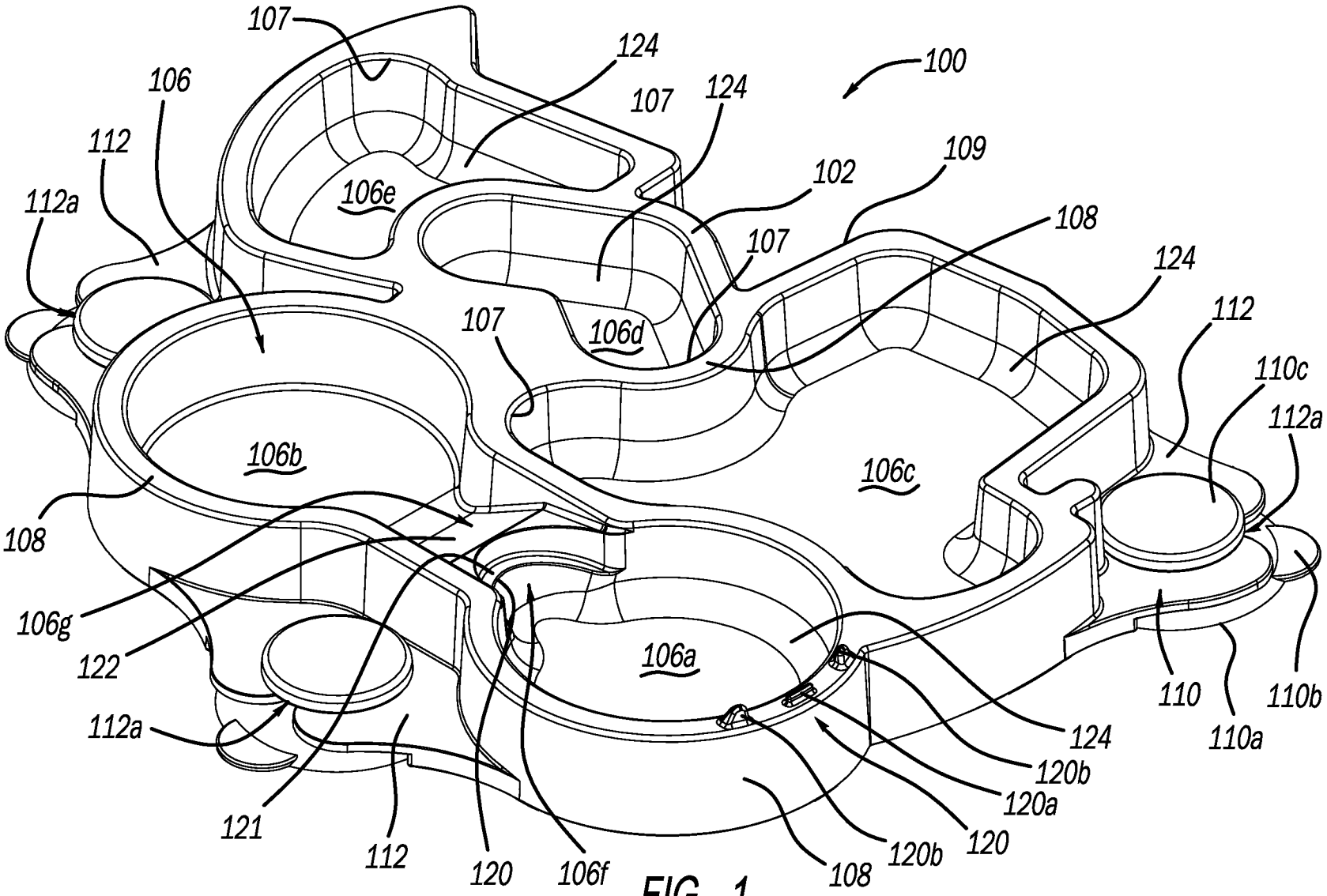
FIG. 1 is a perspective view of a plate configured for holding food, the plate including plurality of recessed regions and having the shape of a construction vehicle.
Figure 15:
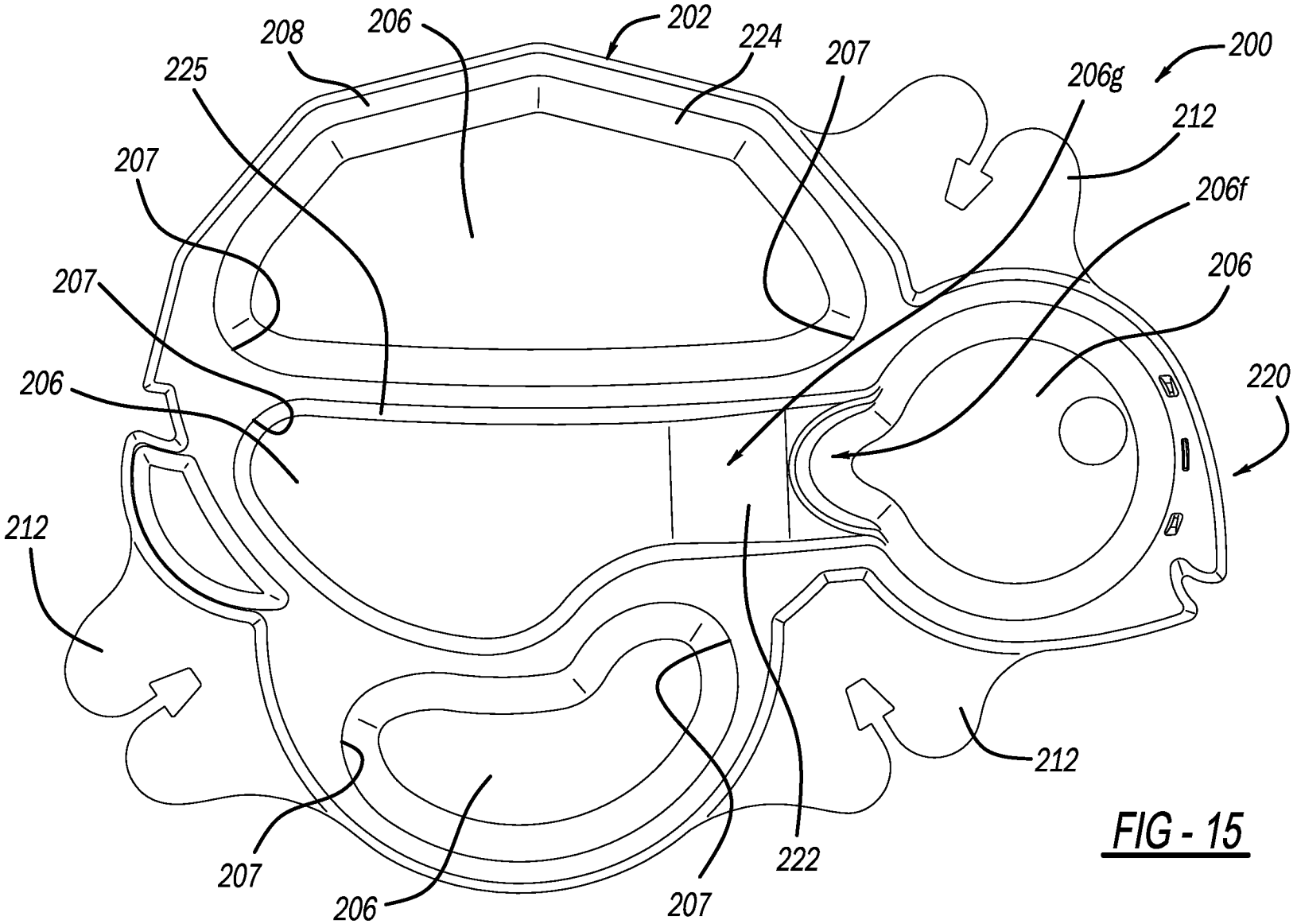
FIG. 15 is a top view of another aspect of the system, illustrating a plate having the shape of a water or sea animal, such as a turtle.

As shown in FIG. 1, the plate 102 is shaped in the form a construction vehicle, in particular a front loader in the illustrated example. As set forth previously, the plate 102 may be shaped to define different aesthetic features corresponding to a different theme, such as a different vehicle, animal, or object that is appealing to a young child. For example, as shown in FIG. 15, a system 200 having a plate 202 is illustrated in the form of a water or sea animal, such as a turtle in the illustrated example.

The plate 102 includes a plurality of recessed regions 106 defined by a plurality of interconnected walls 108. The recessed regions 106 may also be referred to as recesses 106, and the interconnected walls 108 may also be referred to as sidewalls 108. The plurality of recesses 106 may include a first recess 106*a*, second recess 106*b*, third recess 106*c*, fourth recess 106*d*, fifth recess 106*e*, etc. depending on the defined shape/theme of the plate. The recesses 106 may be separated by a network of the sidewalls 108 disposed around various areas of the plate 102. Accordingly, the sidewalls 108 may be described as defining the recesses 106 of the plate. The shape and distribution of the sidewalls 108 and recesses 106 may therefore combine to define the shape/appearance of the theme of the plate 102, in this case a construction vehicle as shown in FIGS. 1-9. The sidewalls 108 and recesses 106 may be considered part of a body portion 109 of the plate 102. The body portion 109 may thereby define the overall shape of the object that is the theme of the plate 102.

In one aspect, the system 100 includes a plurality of securement members 110 that are attached to the plate 102, although securement members may also be integrated into the design of plate as well, as would be known by those of skill in the art. The securement members 110 may be in the form of suction cups, in one aspect, either attachable or integrated. The suction cups 110 may include a downwardly facing cup portion 110*a* that is concave facing downwardly, and convex facing upwardly. The suction cups 110 may further include tab portion 110*b* that projects radially outward from the cup portion 110*a*. The suction cups 110 may further include a head portion 110*c* that is disposed above the cup portion 110*a*, with a neck portion 110*d* (see FIG. 4) that extends between the head portion 110*c* and the cup portion 110*a*. The head portion 110*c* may include a symbol or other graphic molded or printed thereon. In one aspect, the symbol may correspond to the theme of the plate.

The suction cups 110 may be generally flexible and configured to be pressed against a flat surface, with the cup portion 110*a* becoming axially compressed and radially expanded, and thereby secured to the flat surface against which it is pressed. In one aspect, the suction cups 110 may be released from a secured state by pulling on the tab portion 110*b*.

The suction cups 110 may be releasably secured to the plate 102 via a plurality of flanges 112. The flanges 112 extend laterally outward relative to the body portion 109. In one aspect, the flanges 112 do not make up a portion of the theme of the plate 102. In the illustrated example, the flanges 112 do not generally combine with the body portion 109 to define the shape of the construction vehicle.

In one aspect, the flanges 112 define a slot 112*a* generally at the middle of the flange 112. The slot 112*a* may be sized and shaped to receive the neck portion 110*d* of the suction cup 110 to releasably secure the suction cup 110 to the plate 102. The suction cup 110 may be press-fit into the slot 112*a*, with the flange 112 thereby pinching the neck portion 110*d* of the suction cup 110. When secured within the flange 112, the head portion 110*c* of the suction cup 110 is disposed above the flange 112, and the cup portion 110*a* is disposed below the flange 112.

In one aspect, the neck portion 110*d* of the suction cup 110 may have a height that generally corresponds to the thickness of the flange 112. Accordingly, when the suction cup 110 is secured in the flange 112, the positon of the head portion 110*c* and the cup portion 110*a* relative to the flange 112 (and the body portion 109) is generally known. In this aspect, the bottom of the cup portion 110*a* may project lower than the bottom of the plate 102 to account for the cup portion 110*a* flexing and compressing axially/vertically when pressed against the support surface.

In one aspect, three flanges 112 and three corresponding suction cups 110 are disposed around the plate 102 at distinct positions. The use of three suction cups 110 provides triangulation of support and defines a securement plane that is not provided by a single suction cup or a pair of suction cups. Additionally, the use of three suction cups 110 maintains the plate 102 in a secured state in the event the child successfully separates one of the suction cups 100 from the support surface.

However, by using multiple suction cups 110 that are spaced apart from each other, a child cannot release the plate 102 by affecting a single cup, unlike a plate that is itself flexible with a large single suction cup base. In such a case, a child could insert their fingers under one side of the flexible plate and the entire securement mechanism would fail. In the system 100 of the present disclosure, if the child removes one suction cup 110, the plate 102 remains secured via the other two.

Additionally, the slots 112*a* may be arranged and oriented such that they define a unique direction of insertion for each suction cup 110. Accordingly, if the plate is pushed in a single direction in such a way that a single suction cup 110 could slide out of the slot, the other slots 112*a* would block the plate in that direction. Put another way, the slots 112 define vectors that are each directed toward the center of the plate 102. It will be appreciated that the vectors defined by the slots 112*a* need not intersect at a common point.

When the suctions cups 110 are compressed and secured to the support surface, the plate 102 is accordingly secured to the surface, and the plate 102 is easily accessible by the young child to retrieve food from the plate 102 via the utensils 103, 104.

With reference to FIGS. 8-11, utensils 103 and 104 that cooperate with plate 102 are shown. With initial reference to FIG. 8-9, first utensil 103 is in the form of a pusher. Pusher 103 includes a handle portion 103*a* and a food manipulating portion or head portion 103*b*. Handle portion 103*a* has a generally elongate shape. As shown, handle portion 103*a* has a complex curvature, with a concave curvature facing upward near the head portion 103*b* that transitions to a convex curvature at the opposite end of the handle 103*a* (opposite head 103*b*).

Head 103*b*, for the pusher 103, has a generally flat and rectangular shape. In another aspect, the rectangular shape may be a square shape. The head portion 103*b* may have a width that corresponds to the size and shape of one of the recesses 106 or a passageway between recesses, such that the pusher 103 fits within the corresponding recess 106 to allow the food to be pushed through a corresponding opening or passageway defined between recesses 106, as discussed in further detail below. The head portion 103*b* may be in the form of a straight head portion, defining a flat surface with a generally rectangular profile having corners forming generally right-angles. It will be appreciated that the right angles may be defined by a small radius (such as radius R2 shown and described below).

Handle portion 103*a* is formed to coordinate with the shape of the plate 102 in additional aspects as well. In one aspect, handle 103*a* has an inverted U-shape, such that the bottom side of the handle portion 103*a* is open, and the top side is closed. The inverted U-shape therefore defines a rail-type structure with opposing sidewalls. The U-shape may be generally rectangular, with the sidewalls being generally parallel to each other and normal to a top wall from which they depend. In an alternative aspect, the sidewalls may be canted inward or outward relative to each other, such as in a generally trapezoidal shape is defined. In any case, the sidewalls may have bottom edges thereof that are spaced apart from each other a pre-defined distance or spacing to define the open bottom and generally hollow shape of the handle portion 103*a*, defining a cavity therein.

The spacing between sidewalls of the handle portion 103*a* is advantageously arranged at least at a middle portion of the length of the handle portion 103*a* such that the handle portion 103*a* and the utensil may be predictably mated with the plate 102 via a corresponding set of one or more retention features or projections 120 (see FIGS. 1 and 2) extending from the base portion 109 of the plate 102.

Handle portion 104*a* of utensil 104 may have similar sizing and spacing as described above, such as including a cavity. However, handle portion 104*a* and 103*a* need not have the same sizing and spacing. For example, while both handle portions 104*a* and 103*a* may have similar sizing and spacing to define a bottom opening, handle portion 103*a* may have parallel sidewalls while handle portion 104*a* may have trapezoidal sidewalls. The various alternative aspects of the handle portion 103*a* may be equally applied to handle portion 104*a*, and they can be different relative to each other.

With reference again to FIG. 1, projections 120 are shown projecting upwardly from the base portion 109 of the plate 102. Projections 120 include a middle projection 120*a* and a pair of side projections 120*b*. Middle projection 120*a* has a slightly lower profile than side projections 102*b* (see FIG. 5). Middle projection 120*a* is sized and arranged to fit in a cavity between the sidewalls of the handle portion 103*a* of utensil 103 or handle portion 104*a* of utensil 104. Accordingly, handle portion 103*a*/104*a* would be retained by middle projection 120*a* in the event of a force applied laterally against the utensil 103*a*/104*a*. Of course, a large enough force would allow utensil 103*a*/104*a* to move beyond middle projection 120*a*.

Additionally, side projections 120*b* similarly project upwardly and block the sidewalls of the handle portion 103*a*/104*a*, depending on the direction that the handle portion 103*a*/104*a* is being moved. For example, if the handle portion 103*a*/104*a* is pushed to the right, the side projection 120*b* on the right will block the handle portion 103*a*/104*a* from sliding beyond the projection 120*b*.

The side projections 120*b* are spaced apart relative to each other to allow the handle portion 103*a*/103*b*, or the handle portion of another utensil, to be received therebetween. When disposed on the plate 102, the utensil 103/104 may therefore be disposed between both of the side projections 120*b*, with the side projections 120*b* outside of the cavity within the handle portion 103*a*/104*a*, and the middle projection 120*a* being inside of the cavity. Alternatively, the side projections 120*b* may be positioned outside of and secure the outside walls of the handle portion of another or differently configured utensil.

In one aspect, the width of the opening or cavity between sidewalls may correspond to the distance between surfaces of the middle portion 120*a* and one of the side projections 120*b*. Thus, when the handle portion 103 is pushed to one side, the handle 103*a* will contact both the middle projection 120*a* and the side projection 120*b* at generally the same time. The size and shape of the projections 120*a* and 120*b* and handle portion 103*a*/104*a* may be arranged such that the handle portion 103*a*/104*a* may shift slightly from side to side while being retained between the side projections 120*b* and while capturing the middle projection 120*a*.

The outer or side projections 120*b*, in addition to serving as a second line of defense to retain the utensil 103/104 if the middle projection 120*a* is overcome, may also operate to retain utensils having other shapes, such as those without a cavity. In such a case, the middle projection 120*a* may support the handle of such a utensil, with the handle being retained between the side projections 120*b*.

In another aspect, the retention features 120 may be in the form of slots or depressions formed in the upper surface of the sidewall 108 at a similar location as projections 120.

It will be appreciated that the above discussion regarding the handle 103*a* and projections 120 are equally applicable to the handle 104*a*, and reference made only to handle 104*a* or 103*a* shall not be interpreted to exclude other similar handles from such functionality. Additionally, it will appreciated that the handle 104*a* (or handles of other similar utensils) may have a different specific size relative to handle 103*a* and still be retained by the same set of projections 120, with a corresponding difference in the amount of "play" relative to the projections 120.

Figure 10:
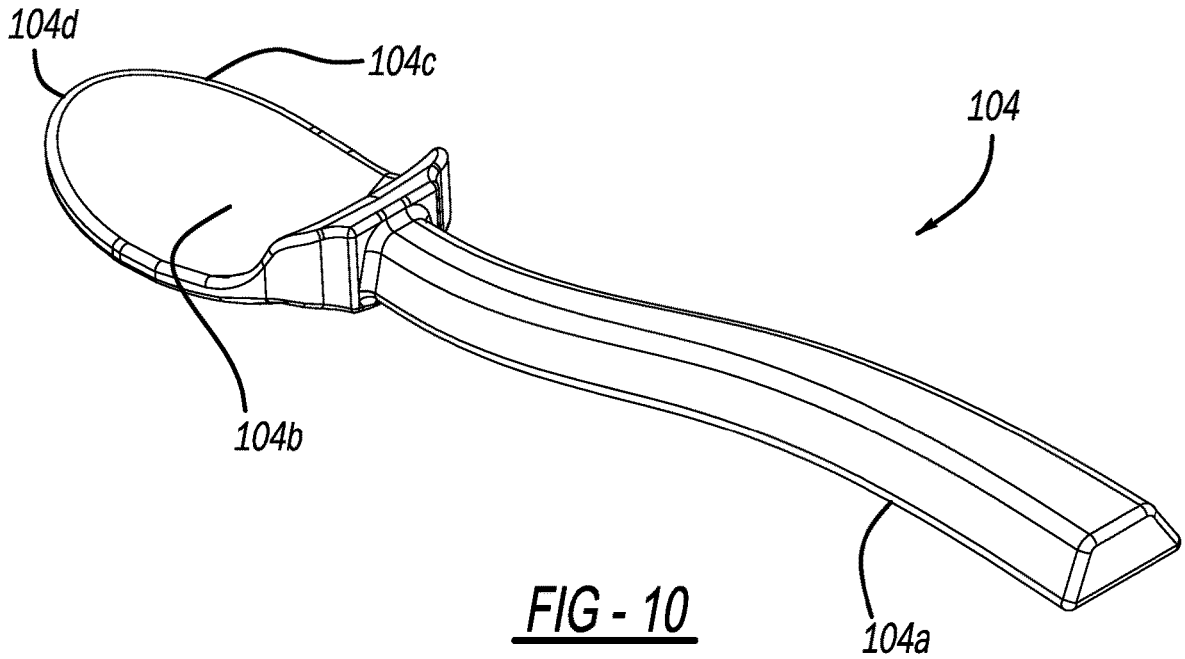
FIG. 10 is a top perspective view a utensil in the form of a spoon.
Figure 11:
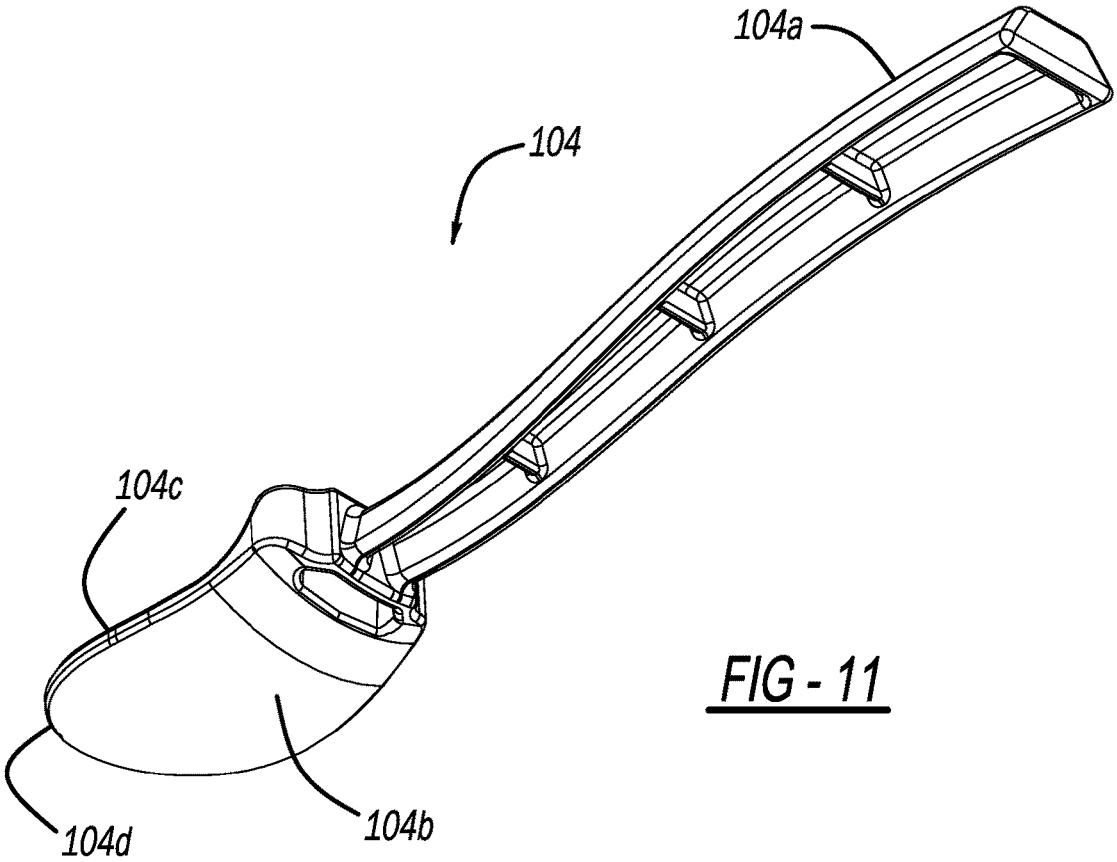
FIG. 11 is a bottom perspective view of the spoon.

With reference to FIGS. 10-11, utensil 104 may be in the form of a spoon. Spoon 104 may include handle portion 104*a* and food manipulating portion or head portion 104*b*. Handle portion 104*a* has been described previously with reference to handle portion 103*a*, and need not be described in further detail with reference to spoon 104.

With reference to head portion 104*b*, particularly in the form of spoon 104, head portion 104*b* may include curved tip portion 104*c*. Curved tip portion 104*c* may define a tip radius 104*d* that corresponds to one or more radii defined within one or more recesses 106, as further described below. Curved tip portion 104*c* may similarly be sized overall to correspond to the shape of one or more recesses 106 or a portion thereof, such that the spoon 104 may mate with one or more of the recesses 106 (or portion thereof) in a first position. When the tip portion 104*c* mates with the corresponding shape of the recess 106, the handle portion 104*a* may be retained on the projections 120.

Figure 12:
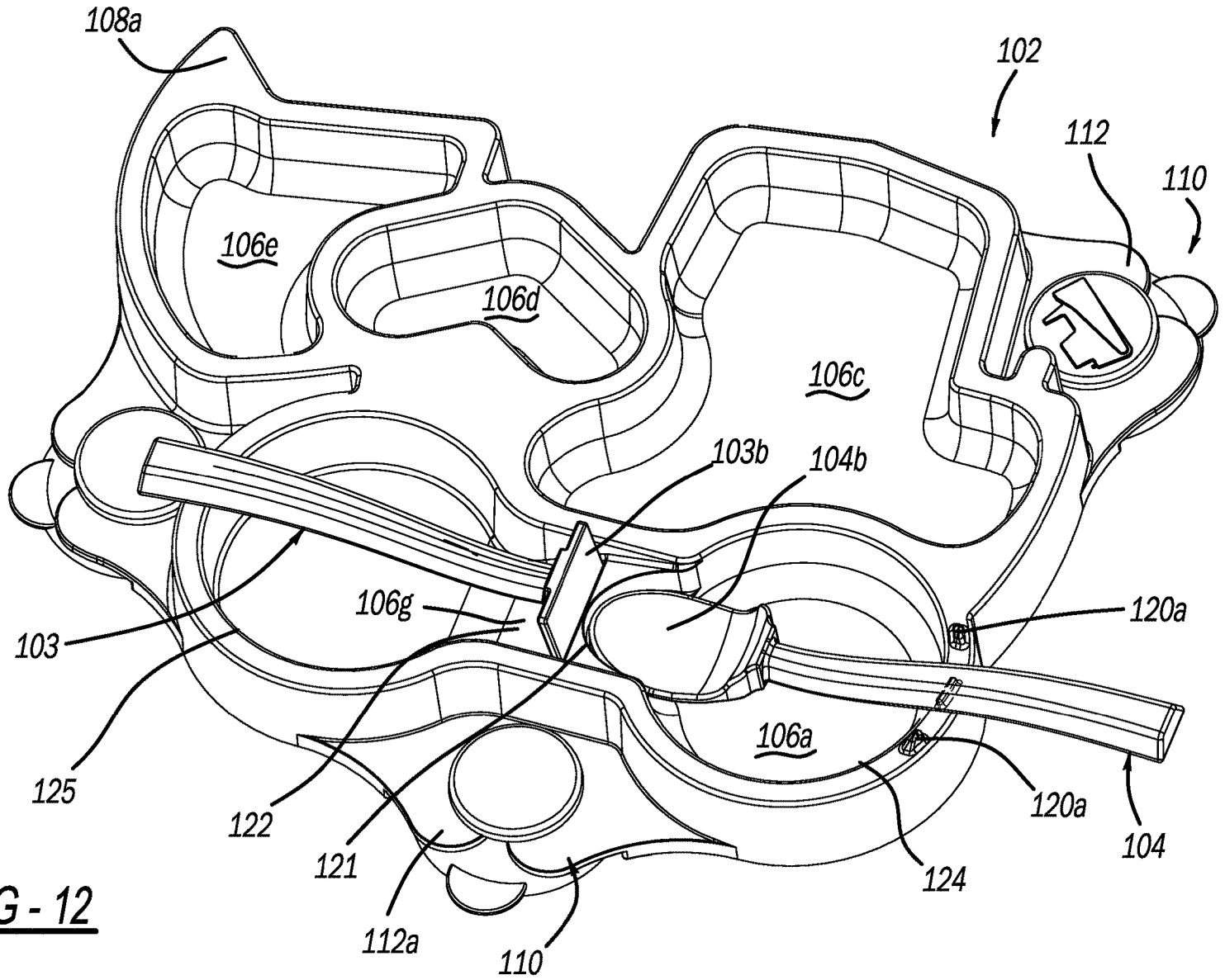
FIG. 12 is a perspective view of the spoon retained on the plate and the pusher interacting with the plate.

FIG. 12 illustrates one example of spoon 104 being mated with and retained by the plate 102. FIG. 12 further illustrates pusher 103 interacting with the plate. The head portion 104*b* of spoon 104 is received in recess 106*a* and the handle portion 104*a* is retained by the projections 120. The head portion of pusher 103 is shown disposed on ramp 122, further described below. In one aspect, projections 120 may also be disposed on another sidewall 108 to retain pusher 103 while the head of pusher 103 is on ramp 122, similar to projections 120 retaining spoon 104 when the head of spoon 104 is received in recess 106*a*.

As described previously, both the head portion 103*b* of the pusher 103 and the head portion 104*b* of the spoon 104 may be sized to corresponding shapes or portions of one or more of the recesses 106 formed in the body portion 109 of the plate 102. The various recesses 106 and their various shapes will now be described in further detail.

Figure 2:
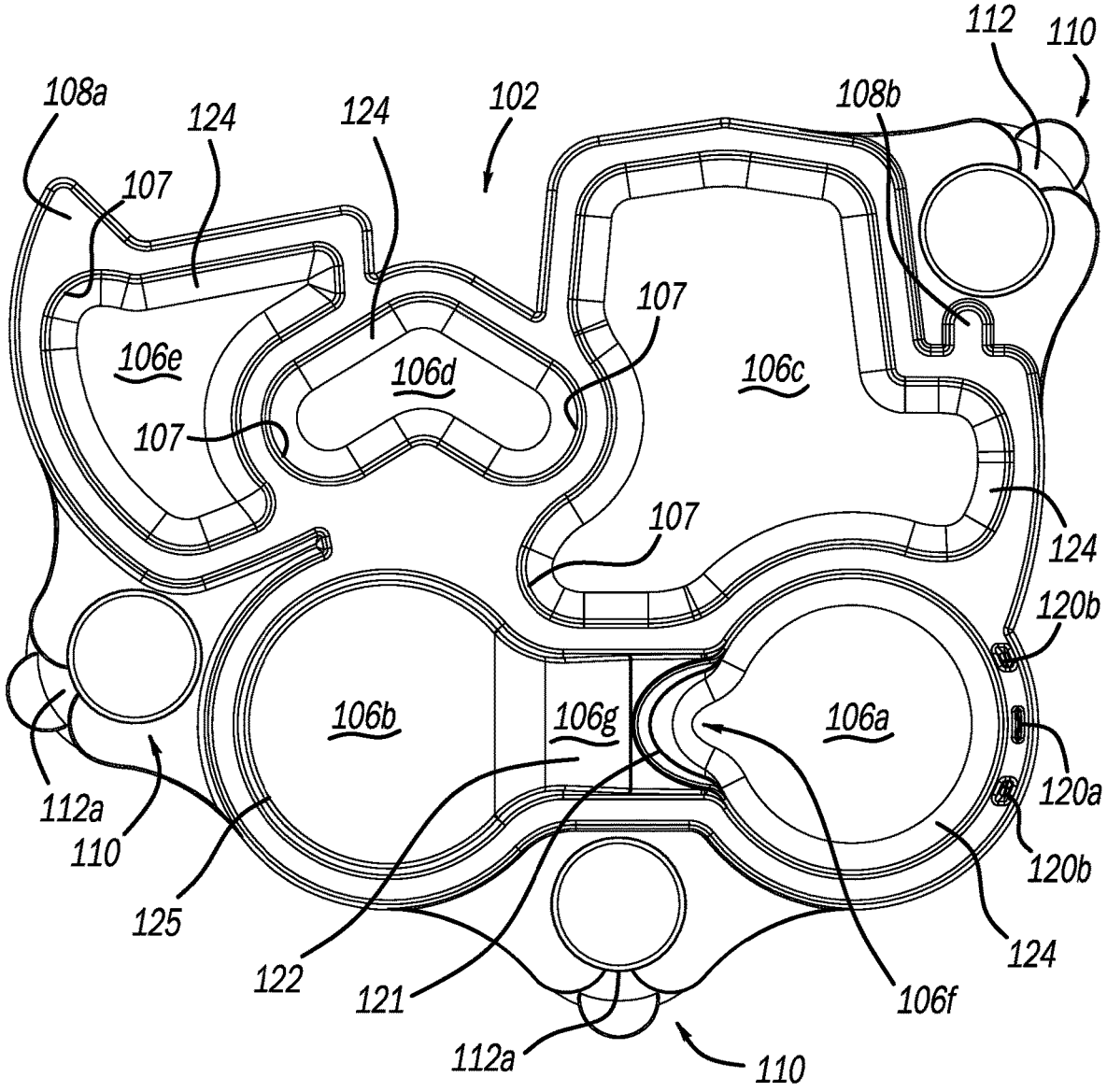
FIG. 2 is a top view of the plate.

With reference to FIGS. 1 and 2, recess 106*a* is disposed in the lower right corner of the plate 102, and is the recess that is disposed closest to and adjacent to the projections 120. Put another way, the projections 120 project upwardly from the sidewall 108 that defines at least a portion of the recesses 106*a*.

Recess 106*a* has a generally circular overall profile when viewed from above, as shown in FIG. 2. However, the overall profile is not entirely circular, as the recess 106*a* is shaped to be in fluid communication with adjacent recess 106*b*. Moreover, recess 106*a* further defines dock portion 106*f*. Dock portion 106*f* has a curved profile with a wall portion that has a curvature corresponding in shape to the curvature and shape of the tip portion 104*c* of spoon 104. Dock portion 106*f* further defines a curved ledge portion 121 that has a curved profile corresponding to the curvature of the outer curved edge of tip portion 104*c*, such that when spoon 104 is disposed within dock portion 106*f*, the spoon 104 will be supported by the ledge portion 121. Accordingly, tip portion 104*c* may be received in dock portion 106*f* and supported by ledge portion 121 when the spoon 104 is in the first position. FIG. 12 illustrates this arrangement.

In addition to dock portion 106*f* of recess 106*a*, body portion 109 of plate 102 further defines recessed passageway portion 106*g*. Passageway portion 106*g* fluidly links recess 106*a* to adjacent recess 106*b*. Accordingly, food from recess 106*b* may be transferred to recess 106*a* without being lifted out of plate 102.

Plate 102 further includes ramp portion 122, which defines passageway portion 106*g* fluidically connecting recess 106*b* to recess 106*a* below the upper surface of the corresponding defining sidewalls 108. Ramp portion 122 extends upwardly from the base or lower surface of recess 106*b* toward dock portion 106*f*, thereby defining a ramped surface from recess 106*b* toward recess 106*a* via passageway portion 106*g*. The recesses 106*a* and 106*b* have non-contiguous lower surfaces, with the ramp 122 facilitating movement of food from recess 106*b* to recess 106*a*.

According to an aspect of the disclosure, pusher 103, in particular the head portion 103*b*, is sized to correspond to the size and shape of passageway portion 106*g* and ramp portion 122. In one aspect, the width of head portion 103*b* corresponds to the width of passageway portion 106*g*, such that pusher 103 may slide up ramp portion 122 and force food upward along the ramp portion 122 into recess 106*a*. In one aspect, the width of pusher 103 may be slightly less than the width of the passageway portion 106*g* to aid in fitting and sliding the pusher 103 up the ramp portion 122.

In one aspect, the ramp portion 122 may include multiple segments having different angles of inclination. For example, a transition at the base of the ramp portion 122 near recess 106*b* may have different angle of inclination relative to the adjacent segment of the ramp portion 122 that leads toward recess 106*a*. The segment defining the transition may be curved or may have a fixed slope. For the purposes of illustration, the transition is shown as curved.

In another aspect, one or more of the recesses 106 may include a nesting region 107. The nesting region 107 may have a shape corresponding to the shape and/or curvature of the head portion of the spoon 104. The nesting region 107 have other shapes corresponding to the size and shape of other utensils. The nesting region allows the corresponding utensil to be placed and/or nested therein and further allows for food to be pushed into the nesting region 107 and then substantially removed due to the matching shapes.

Figure 13:
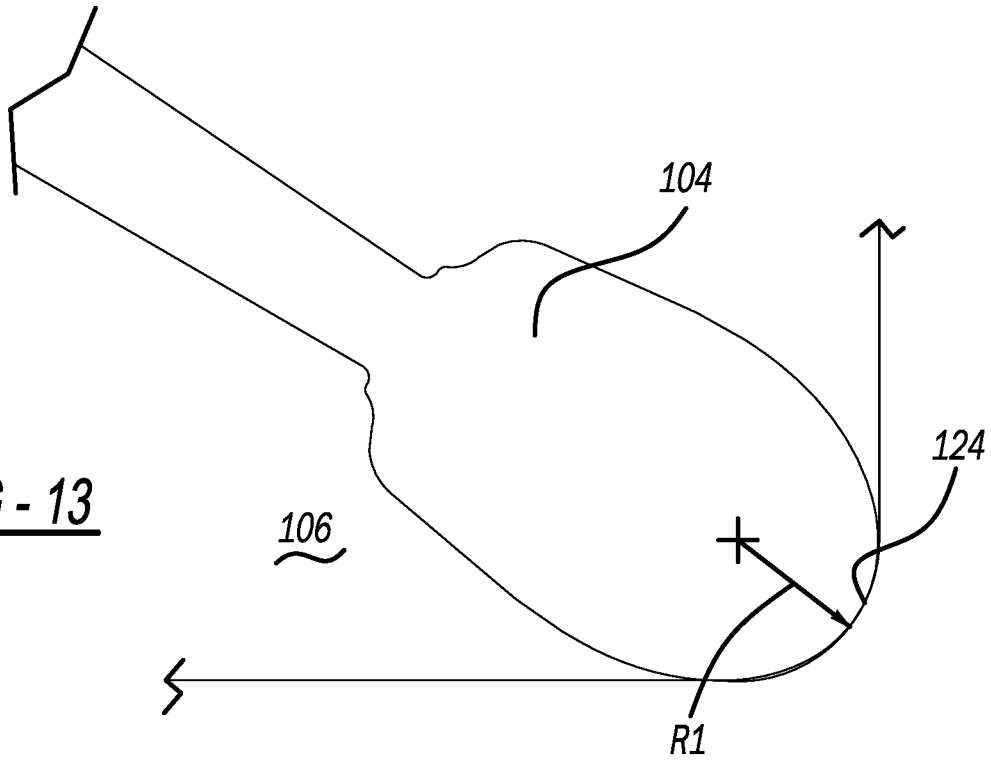
FIG. 13 is a schematic view illustrating a transition region between the wall and lower surface of a recessed region that corresponds to the shape of the spoon.

In another aspect, the recess 106*a*, as well as other ones of the plurality of recesses 106, may include a transition region 124 in the form of curved inner corner 124 that extends generally around the bottom profile of the recesses 106. Inner corner 124 may be defined by a radius R1 that corresponds to the radius 104*d* of the tip portion 104*c* of the spoon 104. Accordingly, when retrieving food from within the recesses 106 via the spoon 104, essentially the entire recess 106 having the inner corner 124 is accessible via the spoon 104. FIG. 13 illustrates the corresponding curvature of corner 124 with that of spoon 104.

Figure 14:
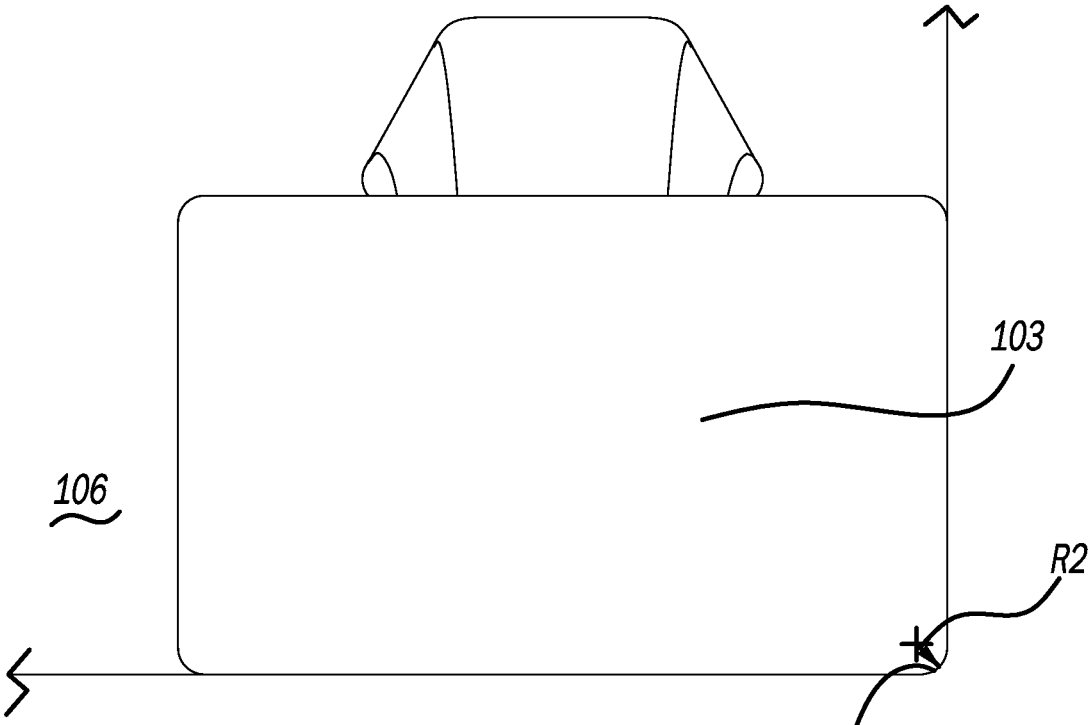
FIG. 14 is a schematic view illustrating a transition region between the wall and lower surface of a recessed region that corresponds to the shape of the pusher.

In another aspect, one or more of the recesses 106 may include another transition region 125 that is different from the transition region 124, with the transition region 125 in the form of second radiused inner corner 125 having a radius R2 that corresponds to a corner radius of the head portion 103*b* of the pusher 103. In one aspect, the radius R2 may be sufficiently small so as to define a right angle between the bottom or lower surface of the recess 106 and the defining sidewall 108. Accordingly, the entirety of the recess 106*b* may be contacted by the pusher 103 having a matching small radius or right angle corner. Thus, pusher 103 and spoon 104 may cooperate with plate 102 to manipulate food within the various recesses 106 defined by the plate 102. Different recesses 106 defined by the plate 102 may be sized and shaped to be used with the spoon 104 or the pusher 103. FIG. 14 illustrates the corresponding curvature of corner 125 with that of pusher 103. The radius R2 is smaller than the radius R1 of corner 124.

With further reference to FIG. 1, body portion 109 of plate 102 may include an uppermost surface 109*a* that is defined by the network of sidewalls 108. The recesses 106 are defined and recessed relative to the uppermost surface 109*a*. Thus, recesses 106*a* and 106*b* may be considered fluidly connected below the uppermost surface 109*a*. In contrast, recesses 106*c*, 106*d*, and 106*e* are fluidly isolated relative to each other and relative to recesses 106*a* and 106*b*. It will be appreciated that the arrangement of recesses 106 shown in FIG. 1 and described herein are examples and that other arrangements may be used such that more than two recesses may be fluidly coupled, or all recesses are fluidly coupled, relative to the uppermost surface 109*a*. The specific size and shape and arrangement of recesses may be tailored to define a shape or appearance to correspond to a desired theme.

As shown in FIGS. 1 and 2, the recesses 106 and sidewalls 108 may be arranged to define an overall shape corresponding to an object. As shown, the object is a construction vehicle, and in particular a front loader. It will be appreciated that other objects, such as vehicles, animals, characters, or the like may be defined by the arrangement of recesses and sidewalls of the body portion 109 of the plate 102.

With further reference to the illustrated example, recesses 106*a* and 106*b* define the shape of the wheels of the front loader. Recess 106*c* defines the shape of the cab. Recess 106*d* defines the mechanical linkage that supports the shovel portion. Recess 106*e* defines the shovel portion.

In addition to the recesses defining portions of the illustrated object, the sidewalls 108 may also define or enhance the appearance of other portions. In one aspect, sidewall projection 108*a* may add further definition of the shape of the illustrated object. As shown in FIGS. 1 and 2, sidewall projection 108*a* is defined by an increased thickness that creates a triangular protrusion at the tip of the shovel portion, illustrating the teeth of the shovel portion. Similarly, sidewall projection 108*b* extends near the cab portion, illustrating an antenna or other projecting feature of the front loader.

The flanges 112, described above, may be recessed or set back relative to the uppermost surface 109*a* of the body portion 109, such that the flanges 112 may appear excluded from the overall defined shape. The sidewalls 108, including the sidewall projections 108*a*, may therefore define the overall outer profile of the desired shape of the illustrated object. The flanges 112, however, combine with the sidewalls 108 to define the overall outer profile of the plate 102.

Figure 3:
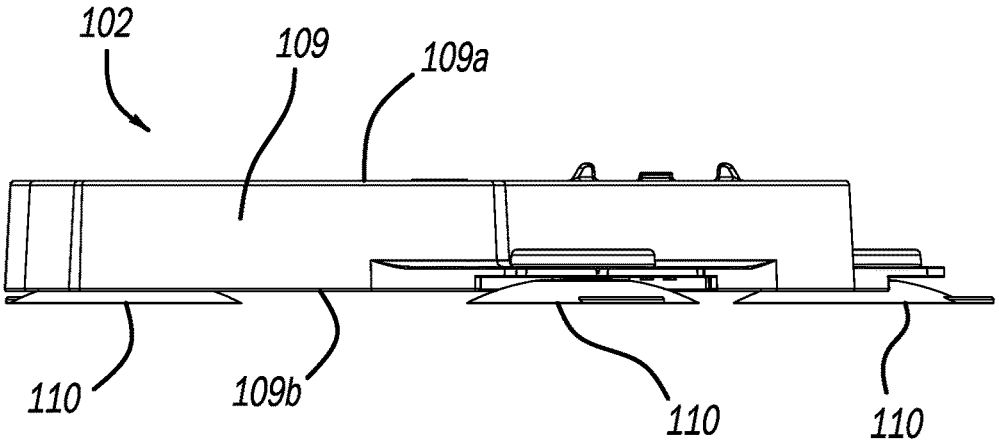
FIG. 3 is a left side view of the plate.
Figure 4:
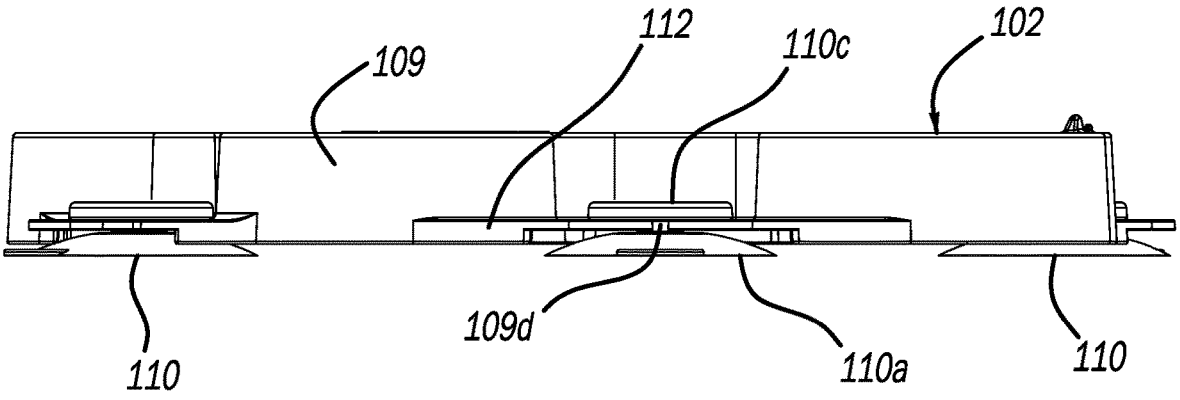
FIG. 4 is front view of the plate.
Figure 5:
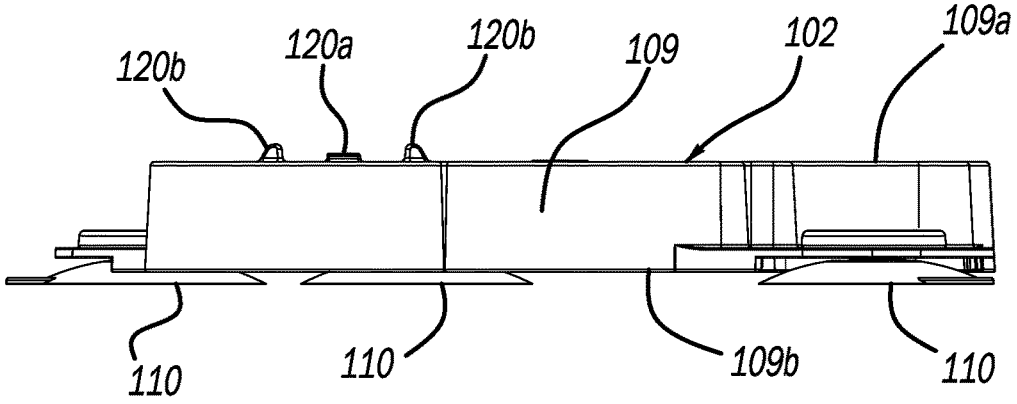
FIG. 5 is a right side view of the plate.
Figure 6:
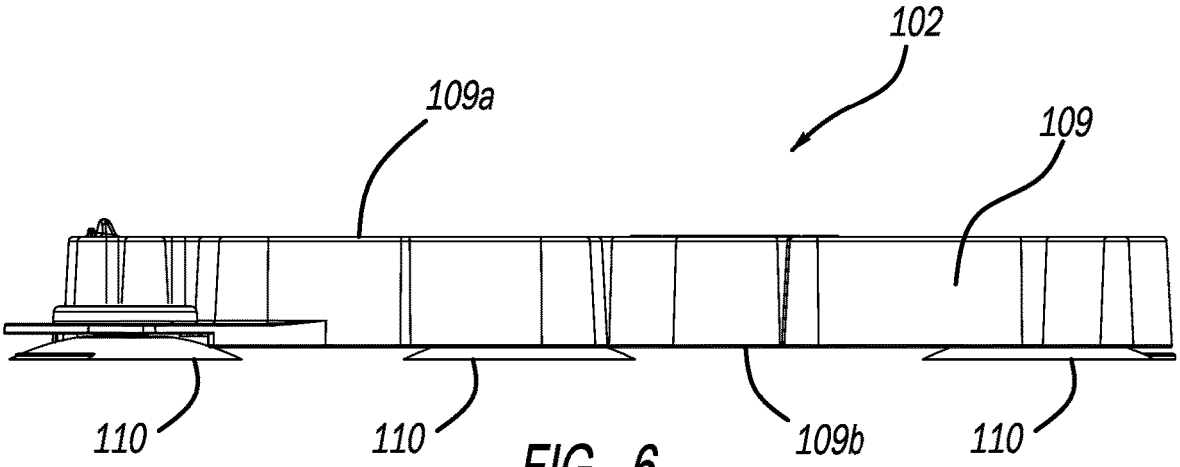
FIG. 6 is a rear view of the plate.
Figure 7:
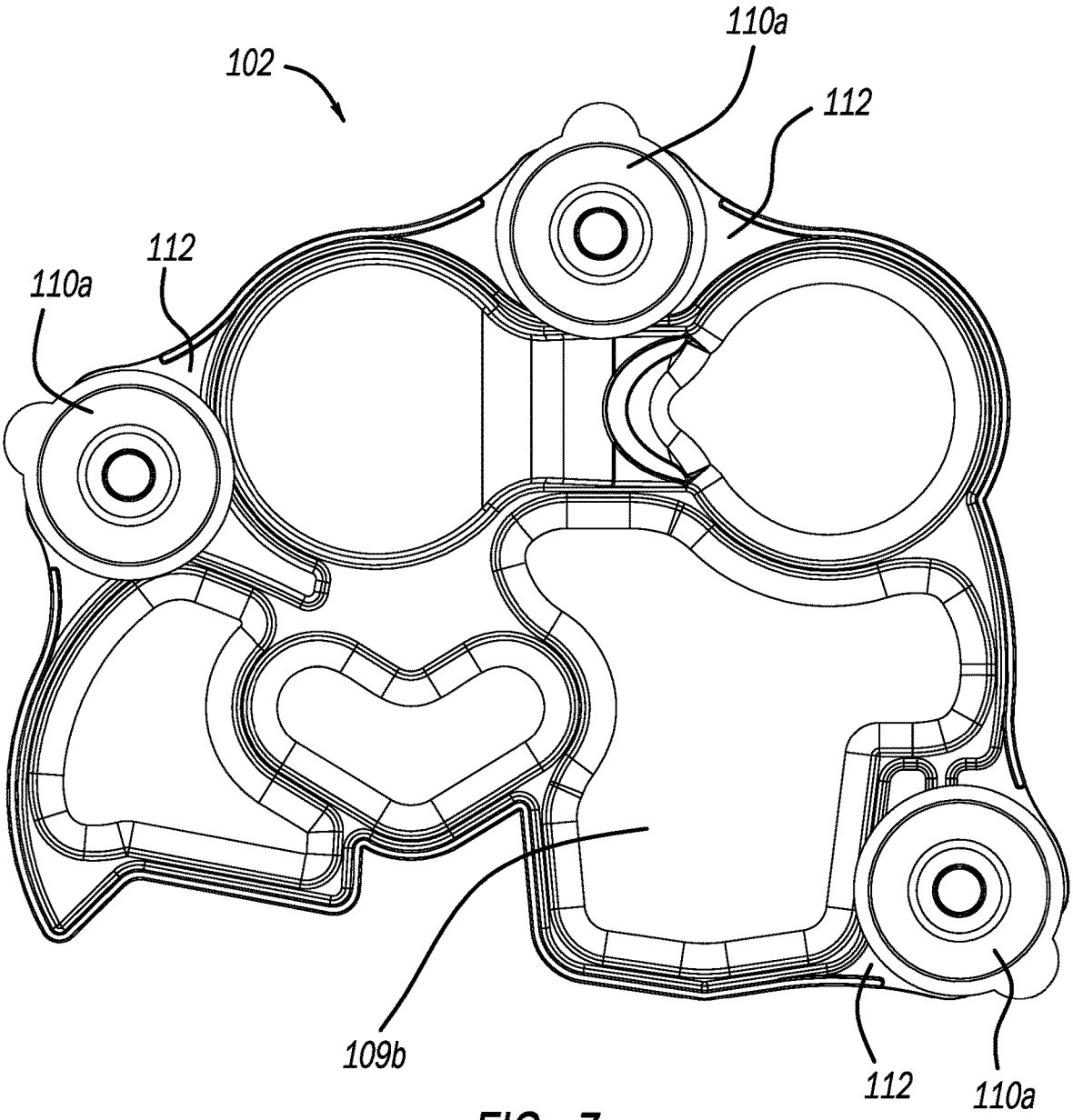
FIG. 7 is a bottom view of the plate.
Figure 8:
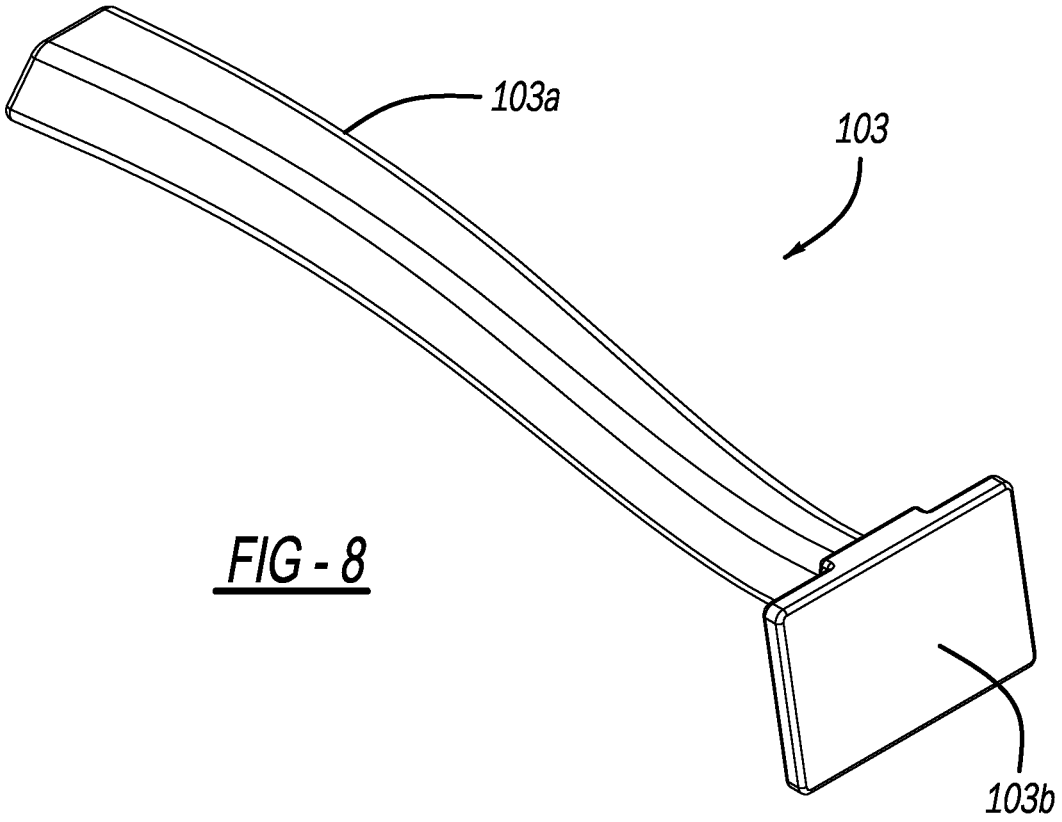
FIG. 8 is a top perspective view of a utensil in the form of a pusher.
Figure 9:
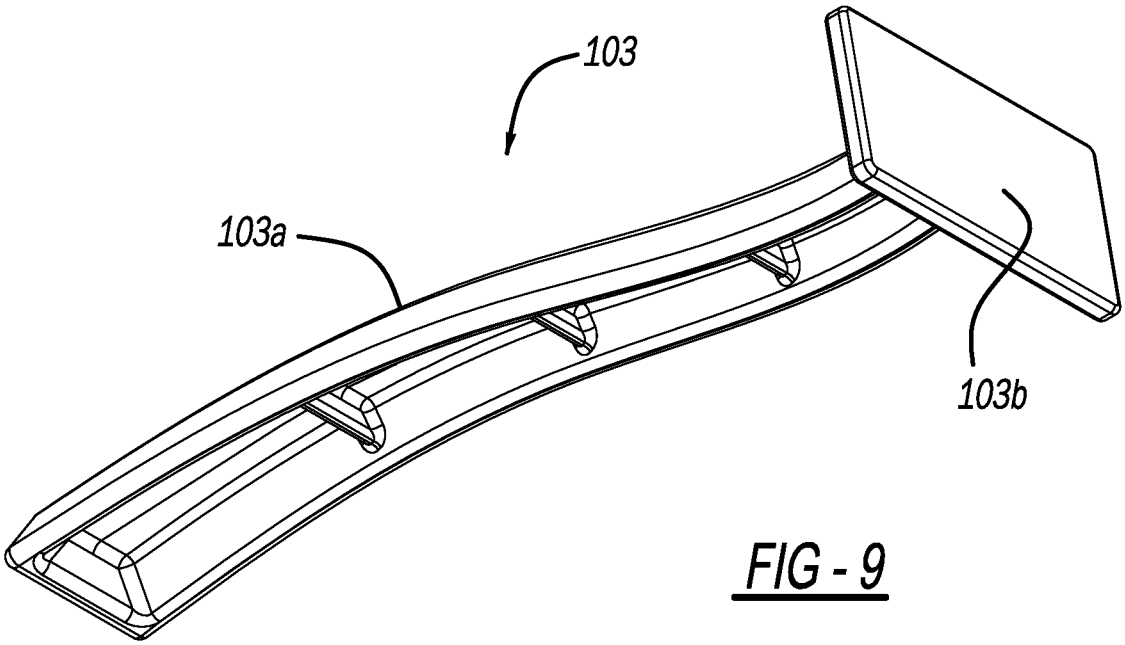
FIG. 9 is a bottom perspective view of the pusher.

The body portion 109 further defines a lowermost surface 109*b* (see FIGS. 3 and 7). As described above with respect to the suction cups 110, the bottom of the cup portions 110*a* are disposed below the body portion 109. More particularly, the bottoms of the cup portions 110*a* are disposed below the bottommost surface 109*b*. Accordingly, there is space below the body portion 109 to allow the cup portions 110*a* to compress, thereby bringing the bottommost surface 109*b* closer to the support surface. The amount that the cup portion 110*a* projects below the bottommost surface 109*b* may be tailored based on the size of the cups and the amount of compression expected based on the material used.

The plate 102 is preferably injection molded and formed of a hard and rigid plastic material. Accordingly, when pushed downward, the downward force may be applied substantially to the flexible suction cups 110. Additionally, the hard and rigid shape of the plate 102 is resistant to food that is forced against the sidewalls of the recesses 106, thereby keeping food contained relative to flexible dishes or plates.

The body portion 109, and the various portions thereof may be monolithically and integrally formed and having a homogeneous material. The flanges 112 may also be monolithically and integrally formed with the body portion 109, defining the overall size and shape of the plate 102. The suction cups 110 may be formed of a different, more flexible material and are assembled with the plate 102 via the flanges 112, as described above, although the suction cups may also be integrated into the flanges or plate.

FIGS. 1-12 have illustrated one type of system 100 in the form of a plate 102 shaped to represent a construction vehicle. FIG. 15 illustrates another system 200 having a plate 202 shaped like a turtle. As described previously, various other aesthetic appearances of the system may be created by varying the size and shape of the body portion and its interconnected walls and recessed regions.

The above description of the features and functionality of the system 100 are equally applicable to the system 200 having the plate 202. Thus, among other features described above, the plate 202 includes interconnected walls 208, recessed regions 206, transition regions 224, 225, ramp portion 222, passageway 206*g*, nesting regions 207, dock 206*f*, retention feature 220, flanges 212, securement members (not shown), etc. Thus, the above description of system 100 also applies to system 200.

As a person skilled in the art will readily appreciate, the above description is meant as an illustration of an implementation of the principles of this invention. This description is not intended to limit the scope or application of this invention in that the invention is susceptible to modification, variation, and change, without departing from the spirit of this invention, as defined in the following claims.

What is claimed is:

1. A system for interacting with food, the system comprising:

a plate having a body portion;

an eating utensil having a head portion and a handle portion;

interconnected walls within the body portion of the plate defining a plurality of recessed regions having sidewalls;

the interconnected walls defining an uppermost surface, wherein the plurality of recessed regions include a lower surface recessed relative to the uppermost surface; and at least one retention feature positioned on the uppermost surface of at least one of the interconnected walls, wherein the at least one retention feature retains an eating utensil during use with at least one of the recessed regions of the plate;

wherein the at least one retention feature retains the handle portion of the eating utensil when the head portion of the eating utensil is disposed within at least one of the recessed regions;

wherein the at least one retention feature comprises multiple retention features positioned on the uppermost surface of at least one of the walls;

wherein the multiple retention features comprises a plurality of projections including a middle projection disposed between a pair of side projections, wherein a space is defined between the middle projection and the side projections such that when the eating utensil is retained a U-shaped cross-section of the handle portion is held between the side projections and disposed on each side of the middle projection.

2. The system of claim 1, wherein the at least one of the recessed regions includes a nesting region having a shape substantially matching the shape of the head portion of the eating utensil.

3. The system of claim 1 wherein multiple recessed regions include a nesting region having a shape substantially matching the shape of the head portion.

4. The system of claim 1, wherein at least one of the recessed regions includes a dock portion that retains the head portion of the eating utensil.

5. The system of claim 4, wherein the dock portion includes a ledge that elevates the head portion above the bottom surface of the at least one recessed region.

6. The system of claim 1, wherein the plurality of recessed regions have a transition region between the walls defining the recessed regions and the bottom surface of the recessed regions, wherein the transition region is different for at least one of the recessed regions as compared to the transition region of at least one other recessed region.

7. The system of claim 6, wherein the transition region of the at least one recessed region is substantially curved.

8. The system of claim 7, wherein the transition region of the at least one recessed region that is substantially curved is configured to mate with a curved portion of the head portion of the eating utensil.

9. The system of claim 6, wherein the transition region of the at least one recessed region forms a substantially right angle between the wall and bottom surface of the recessed region.

10. The system of claim 9, wherein the transition region that forms the substantially right angle between the wall and bottom surface of the recessed region is configured to mate with at least one straight portion of the head portion of the eating utensil.

11. The system of claim 1, wherein the plate is constructed of a substantially rigid material.

12. The system of claim 1, wherein the at least one retention feature mates with a cavity portion of the handle portion of the eating utensil.

13. The system of claim 1, further comprising a further eating utensil having a further head portion and a further handle portion, wherein at least one of the multiple retention features positioned on the uppermost surface of at least one of the sidewalls retains the handle portion of the eating utensil, and at least one of the multiple retention features positioned on the uppermost surface of at least one of the sidewalls retains the further handle portion of the further eating utensil when the further head portion is disposed within the at least one recessed region.

14. The system of claim 1, wherein the plate includes a plurality of flange portions projecting laterally outward from the body portion, wherein the flange portions are disposed below the uppermost surface of the body portion.

15. The system of claim 14, further comprising a plurality of securement members attached to the flange portions, wherein the securement members are flexible and project below a bottommost surface of the body portion of the plate.

16. The system of claim 15, wherein the plurality of flange portions comprises three flange portions and three associated securement members.

17. The system of claim 15, wherein the plate is configured to be secured to a surface by three securement members positioned at points on a periphery of the plate to resist tipping or flipping of the plate.

18. The system of claim 15, wherein the flanges each define slots extending along a vector directed toward the body portion of the plate, wherein the securement members are disposed within the slots, and wherein a lateral force applied to the plate is resisted by at least one of the securement members and the associated slot.

19. The system of claim 15, wherein the securement members are removable from the plate.

20. A system for interacting with food, the system comprising:

a plate having a body portion;

an eating utensil having a head portion and a handle portion;

interconnected walls within the body portion of the plate defining a plurality of recessed regions having sidewalls;

the interconnected walls defining an uppermost surface, wherein the plurality of recessed regions include a lower surface recessed relative to the uppermost surface; and at least one retention feature positioned on the uppermost surface of at least one of the interconnected walls, wherein the at least one retention feature retains an eating utensil during use with at least one of the recessed regions of the plate;

wherein the at least one retention feature retains the handle portion of the eating utensil when the head portion of the eating utensil is disposed within at least one of the recessed regions;

wherein at least two of the recessed regions are separated so as to include non-contiguous lower surfaces, but which recessed regions are fluidically connected by a passageway extending below the uppermost surface.

21. The system of claim 20, wherein the at least one retention feature comprises multiple retention features positioned on the uppermost surface of at least one of the walls.

22. The system of claim 21, wherein the multiple retention features comprises a plurality of projections including a middle projection disposed between a pair of side projections, wherein a space is defined between the middle projection and the side projections such that when the eating utensil is retained a U-shaped cross-section of the handle portion is held between the side projections and disposed on each side of the middle projection.

23. The system of claim 20, wherein the passageway fluidically connecting the at least two recessed regions includes a ramp to facilitate the transfer of food from one recessed region to another recessed region.

24. The system of claim 23, wherein the ramp includes different segments with different angles of incline.

25. A system for interacting with food, the system comprising:

a plate have a body portion including a plurality of interconnected walls that combine to define a plurality of recessed regions;

an eating utensil having a head portion and a handle portion;

a first recessed region of the plurality of recessed regions that is recessed relative to an uppermost surface of the body portion;

a second recessed region of the plurality of recessed regions that is recessed relative to the uppermost surface of the body portion;

wherein the first and second recessed regions are separated so as to include non-contiguous lower surfaces, a passageway fluidically connecting the first recessed region and the second recessed region below the uppermost surface of the body portion; and a third recessed region of the plurality of recessed regions that is recessed relative to the uppermost surface of the body portion and fluidically isolated from the first and second recessed regions below the uppermost surface;

wherein the first recessed region includes a dock portion having a shape corresponding to the head portion of the eating utensil;

wherein at least one projecting retention member extends upwardly from the uppermost surface of the body portion;

wherein the at least one projecting retention member is disposed on an opposite side of the first recessed region relative to the dock portion, such that the head portion of the eating utensil mates with the dock portion when the handle portion of the eating utensil is retained by the at least one projecting retention member.

26. The system of claim 25, wherein the passageway fluidically connecting the first and second recessed regions includes a ramp to facilitate the transfer of food from the second recessed region to the first recessed region.

27. The system of claim 25, wherein the dock portion includes a ledge that elevates the head portion of the eating utensil above a bottom surface of the first recessed region.

28. The system of claim 27 further comprising a plurality of retention features formed on the upper surface of one of the walls that defines, in part, the first recessed region.

29. The system of claim 25, further comprising a plurality of securement members removably attached to flange portions of the plate, wherein the securement members project below a bottommost surface of the body portion of the plate and are configured to secure the plate to a support surface.

30. A system for interacting with food, the system comprising:

a plate having a body portion;

an eating utensil having a head portion and a handle portion;

interconnected walls within the body portion of the plate defining a plurality of recessed regions having sidewalls;

the interconnected walls defining an uppermost surface, wherein the plurality of recessed regions include a lower surface recessed relative to the uppermost surface; and at least one retention feature positioned on the uppermost surface of at least one of the interconnected walls, wherein the at least one retention feature retains an eating utensil during use with at least one of the recessed regions of the plate;

wherein the at least one retention feature retains the handle portion of the eating utensil when the head portion of the eating utensil is disposed within at least one of the recessed regions;

a dock portion defined in a first recessed region of the plurality of recessed regions;

wherein the retention feature is defined on the upper surface of one of the walls that defines the first recessed region;

wherein the head portion of the first utensil has a size and shape corresponding to the dock portion, and wherein the head portion mates with the dock portion in an elevated position relative to a bottom surface of the first recessed region;

wherein the handle portion mates with and is retained by the retention feature;

wherein at least two recessed regions are separated so as to include non-contiguous lower surfaces, but which recessed regions are fluidically connected by a passageway extending below the upper surface of the walls of the recessed regions, wherein the passageway fluidically connecting the at least two recessed regions includes a ramp to facilitate the transfer of food from one recessed region to another recessed region.

31. The system of claim 30, wherein the handle portion includes a cavity and the head portion defines a rounded end portion, wherein the cavity receives and mates with at least one projection of the retention feature to retain the handle portion and the rounded end portion mates with a ledge of the dock portion.

32. The system of claim 30, wherein at least two of the plurality of recessed regions include a transition region between a bottom surface of the recessed region and the wall defining the recessed region, wherein the transition region is different for at least one of the recessed regions as compared to the transition region of at least one other recessed region, wherein at least one of the transition regions is configured to mate with the head portion.

33. The system of claim 30, wherein at least one of the recessed regions includes a nesting region having a shape substantially similar to the shape of the head portion.

* * * * *